US009728881B2

(12) United States Patent
Endo et al.

(10) Patent No.: US 9,728,881 B2
(45) Date of Patent: Aug. 8, 2017

(54) CONNECTOR TERMINAL, ELECTRICAL CONNECTOR, AND METHOD FOR MANUFACTURING CONNECTOR TERMINAL

(71) Applicant: Dai-ichi Seiko Co., Ltd., Kyoto-shi, Kyoto (JP)

(72) Inventors: Takayoshi Endo, Shizuoka (JP); Jun Mukunoki, Shizuoka (JP); Daisuke Matsushita, Shizuoka (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 15/336,536

(22) Filed: Oct. 27, 2016

(65) Prior Publication Data

US 2017/0125934 A1 May 4, 2017

(30) Foreign Application Priority Data

Oct. 30, 2015 (JP) ..... 2015-214683

(51) Int. Cl.

| | |
|---|---|
| ***H01R 13/514*** | (2006.01) |
| ***H01R 13/03*** | (2006.01) |
| ***H01R 43/16*** | (2006.01) |
| ***H01R 13/41*** | (2006.01) |

(52) U.S. Cl.

CPC ..... *H01R 13/03* (2013.01); *H01R 13/41* (2013.01); *H01R 43/16* (2013.01)

(58) Field of Classification Search

CPC .... H01R 13/03; H01R 25/162; H01R 13/504; H01R 4/02; H01R 13/18; H01R 4/185; H01R 13/113; H01R 13/41; H01R 13/3432; H01R 43/16

See application file for complete search history.

(56) References Cited

U.S. PATENT DOCUMENTS

| | | | | |
|---|---|---|---|---|
| 4,458,971 A * | 7/1984 | D'Urso | ..... | H01R 13/432 439/268 |
| 6,203,385 B1 * | 3/2001 | Sato | ..... | H01R 13/113 439/852 |
| 6,227,882 B1 * | 5/2001 | Ortega | ..... | H01R 23/688 439/101 |
| 6,402,571 B1 * | 6/2002 | Muller | ..... | H01R 13/18 439/745 |

(Continued)

FOREIGN PATENT DOCUMENTS

| | | |
|---|---|---|
| JP | 04-206175 A | 7/1992 |
| JP | 2001-326010 A | 11/2001 |
| JP | 2014-013650 A | 1/2014 |

*Primary Examiner* — Jean F Duverne

(74) *Attorney, Agent, or Firm* — Howard & Howard Attorneys PLLC

(57) ABSTRACT

A connector terminal includes first and second arm parts, an interconnection part, a first contactor formed of a piece of sheet which is in a bent shape so as to have the first end laid over on a second end of the sheet with reference to a bent part that is an opposite side to a side where the first end of the sheet and the second end thereof are present, and a second contactor formed of a piece of sheet which is in a bent shape so as to have the first end laid over on a second end of the sheet with reference to a bent part that is an opposite side to a side where the first end of the sheet and the second end thereof are located, and the second contactor facing the first contactor.

13 Claims, 24 Drawing Sheets

(56) References Cited

U.S. PATENT DOCUMENTS

| | | | | |
|---|---|---|---|---|
| 7,291,046 | B2 * | 11/2007 | Russelburg | H01R 4/185 439/857 |
| 8,915,759 | B2 * | 12/2014 | Miyamoto | H01R 4/02 439/862 |
| 8,944,857 | B2 * | 2/2015 | Mariano | H01R 13/504 439/695 |
| 9,252,516 | B2 * | 2/2016 | Ashibu | H01R 12/79 |
| 9,634,445 | B1 * | 4/2017 | Brandon | H01R 25/162 |
| 2005/0032440 | A1 * | 2/2005 | Kurimoto | H01R 13/18 439/839 |

* cited by examiner

CONNECTOR TERMINAL, ELECTRICAL CONNECTOR, AND METHOD FOR MANUFACTURING CONNECTOR TERMINAL

CROSS-REFERENCE TO RELATED APPLICATION

This application claims the benefit of Japanese Patent Application No. 2015-214683, filed on Oct. 30, 2015, the entire disclosure of which is incorporated by reference herein.

FIELD

This application relates generally to a connector terminal, an electrical connector, and a method for manufacturing the connector terminal, and more particularly, to a connector terminal, an electrical connector, and a method for manufacturing the connector terminal which have a terminal component press-fitted and fastened between a pair of contactors.

BACKGROUND

Electrical connectors to which a fuse is attached are known. Example fuses are a flat fuse and a plate fuse. A pair of tabular connection terminals protrudes from a fuse main part. For example, fuses serve as a male connection terminal. Electrical connectors are provided with a connector terminal that is a fork terminal or a Y-shape terminal. The connector terminal includes a pair of terminal contactors. The tabular connection terminal of the fuse is press-fitted in and held between the pair of terminal contactors.

Patent Literature 1 (Unexamined Japanese Patent Application Kokai Publication No. 2014-013650) discloses such a connector terminal.

FIG. 25 is a perspective view of a connector terminal 30*x* disclosed in Patent Literature 1. The connector terminal 30*x* is provided with a board connection 31*x*, a pair of terminal contactors 32*x*, and a terminal main part 33*x*. The board connection 31*x* is to be inserted in a printed board. The terminal main part 33*x* supports the pair of terminal contactors 32*x*.

The terminal contactors 32*x* hold therebetween the tabular connection terminal of the fuse (male connection terminal). The terminal contactors 32*x* are each formed with a bent piece provided continuously from the terminal main part 33*x* and bent. The bent piece of the terminal contactor 32*x* is a part to be in contact with the male connection terminal. The bent piece includes a double-bent bent part 321*x*, and a contactor 322*x* bent forwardly relative to the bent part 321*x*. The flat surface that is the plated surface of the contactor 322*x* is to be in contact with the tabular connection terminal of the fuse. Hence, a damage to the tabular connection terminal of the fuse and shaving thereof are suppressed.

According to the connector terminal disclosed in Patent Literature 1, a contact surface can be formed without spreading the gap between the respective contact surfaces of the opposing contactors 322*x*. Hence, an increase in size of the terminal main part 33*x* is prevented, while at the same time, the fuse holding performance is enhanced.

When, however, the fuse is to be held, if the contact load to the male connection terminal by the contactors 322*x* is further increased, the connection reliability to the male connection terminal by the contactors 322*x* can be further improved.

SUMMARY

The present disclosure has been made in view of the foregoing circumstances, and an objective is to provide a connector terminal, an electrical connector, and a method for manufacturing the connector terminal which are capable of improving the connection reliability to a terminal component.

A connector terminal according to a first aspect of the present disclosure includes:

a first arm part and a second arm part both extending in a predefined direction;

an interconnection part interconnecting a first end of the first arm with a first end of the second arm part, and formed in a two-way branched shape;

a first contactor formed of a piece of sheet which has a first end connected to a second end of the first arm part, and which is in a bent shape so as to have the first end laid over on a second end of the sheet with reference to a first bent part that is an opposite side to a side where the first end of the sheet and the second end thereof are present, the first contactor being in contact with a terminal component inserted toward the interconnection part; and a second contactor formed of a piece of sheet which has a first end connected to a second end of the second arm part, and which is in a bent shape so as to have the first end laid over on a second end of the sheet with reference to a second bent part that is an opposite side to a side where the first end of the sheet and the second end thereof are present, the second contactor being in contact with the terminal component inserted toward the interconnection part, and the second contactor facing the first contactor, in which an orthogonal line to a bending center line of the first bent part intersects the second arm part.

An orthogonal line to a bending center line of the second bent part may intersect the first arm part.

A direction in which the first arm part extends is desirably in parallel with a direction in which the second arm part extends.

The first contactor desirably includes:

a first support part extending from the first arm part;

the first bent part provided at a tip of the first support part;

a first fold-back part folded so as to be laid over on the first support part with reference to the first bent part, and extending from the first support part toward the second end of the first arm part; and a first contact piece in contact with the terminal component;

a first protruding part in a circular-arc shape and extending toward the first contact piece is desirably formed at the first support part; and an end face of the first contact piece is desirably formed in a circular-arc shape that expands toward the inserted terminal component so as to match a contour shape of the first protruding part.

The second contactor desirably includes:

a second support part extending from the second arm part;

the second bent part provided at a tip of the second support part;

a second fold-back part folded so as to be laid over on the second support part with reference to the second bent part, and extending from the second support part toward the second end of the second arm part; and a second contact piece in contact with the terminal component;

a second protruding part in a circular-arc shape and extending toward the second contact piece is desirably formed at the second support part; and an end face of the second contact piece is desirably formed in a circular-arc shape that expands toward the inserted terminal component so as to match a contour shape of the second protruding part.

A first concavity part is desirably formed in a first surface of the first support part, and a first convexity part corresponding to the first concavity part is formed on a second surface of the first support part;

a second concavity part is desirably formed in a first surface of the first fold-back part, and a second convexity part corresponding to the second concavity part is formed on a second surface of the first fold-back part; and the first convexity part and the second concavity part are desirably engaged with each other.

A third concavity part is desirably formed in the second convexity part.

A third convexity part corresponding to the third concavity part is desirably formed on the second concavity part;

a fourth concavity part is desirably formed in the first convexity part; and the third convexity part and the fourth concavity part are desirably engaged with each other.

An electrical connector according to a second aspect of the present disclosure includes:

the connector terminal according to the first aspect of the present disclosure; and a housing which retains therein the connector terminal, and which is formed of an insulative material.

A method according to a third aspect of the present disclosure is for manufacturing the connector terminal according to the first aspect of the present disclosure, and the method includes:

a first process of forming a sheet metal comprising an arm part forming area that becomes the first arm part and the second arm part, an interconnection part forming area which extends from the arm part forming area, and which becomes the interconnection part, and a contactor forming area which extends from the arm part forming area, and which becomes the first contactor and the second contactor;

a second process of bending, from the contactor part forming area, a contact piece forming area that becomes a first contact piece and a second contact piece both to be in contact with the terminal component, and causing the first contact piece and the second contact piece to face with each other; and a third process of bending a second end of the contactor part forming area in a manner laid over on a first end thereof so as to cause an orthogonal line to the bending center line of the first bent part and an orthogonal line to the bending center line of the second bent part to intersect the second arm part and the first arm part.

The contactor part forming area desirably includes:

a support part forming area which extends from the arm part forming area, and which becomes the first support part and the second support part;

a fold-back part forming area that becomes a first fold-back part and a second fold-back part to be bent and laid over on the first support part and the second support part, respectively; and the contact piece forming area;

a first protruding part and a second protruding part both formed in a circular-arc shape are desirably formed at the support part forming area; and the second process desirably includes forming the contact piece forming area in a circular-arc shape in a manner matching a contour shape of the first protruding part and a contour shape of the second protruding part.

The connector terminal manufacturing method desirably further includes a fourth process of punching the support part forming area and the fold-back part forming area laid over with each other from a side where the support part forming area is present.

The connector terminal manufacturing method desirably further includes a fifth process of punching a convexity part formed on the support part forming area and a convexity part formed on the fold-back part forming area from a side where the fold-back part forming area is present, the convexity parts both formed in the fourth process.

According to the present disclosure, a part to be in contact with the terminal component can be shifted toward the inserted terminal component toward the interconnection part. Hence, the connector terminal of the present disclosure is capable of being in contact with and fastening a male connection terminal at a high contact load. Consequently, the connection reliability to the terminal component is improvable.

BRIEF DESCRIPTION OF THE DRAWINGS

A more complete understanding of this application can be obtained when the following detailed description is considered in conjunction with the following drawings, in which.

DETAILED DESCRIPTION

First Embodiment

Figure 1:
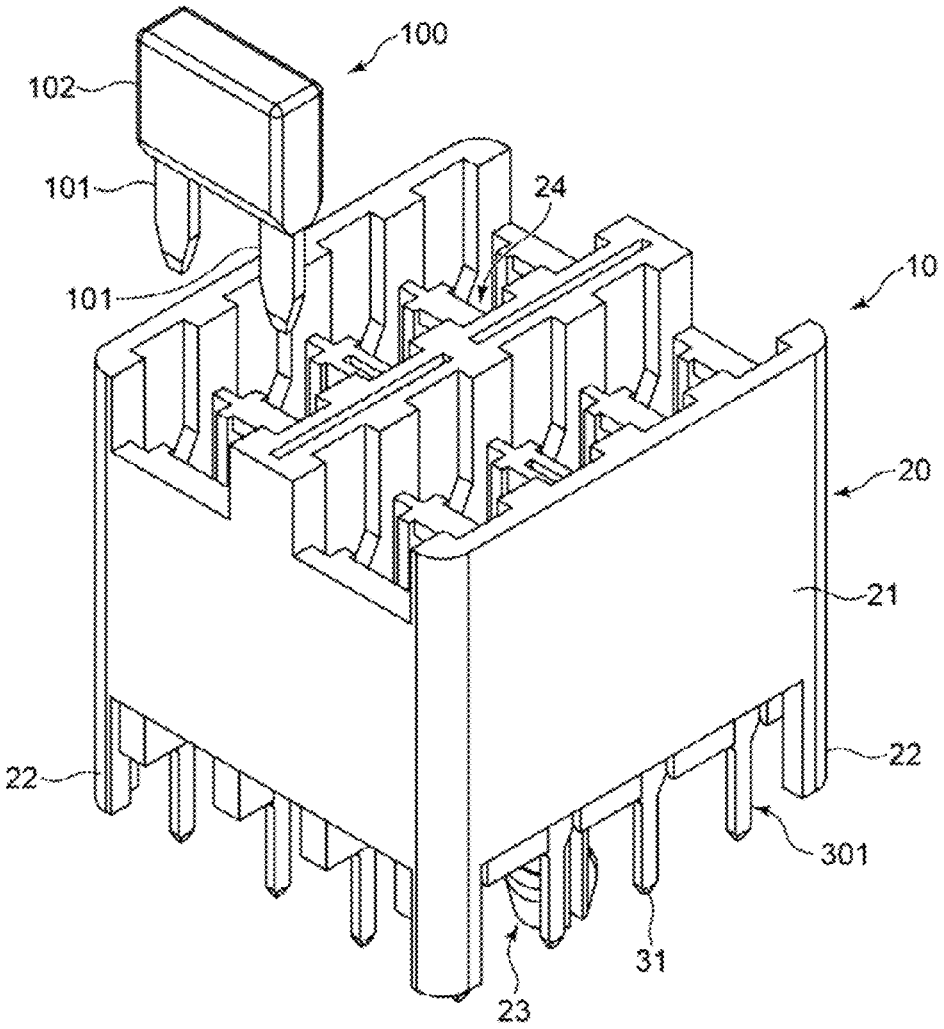
FIG. 1 is a perspective view illustrating an electrical connector according to a first embodiment of the present disclosure, and a fuse to be attached to this electrical connector.
Figure 2:
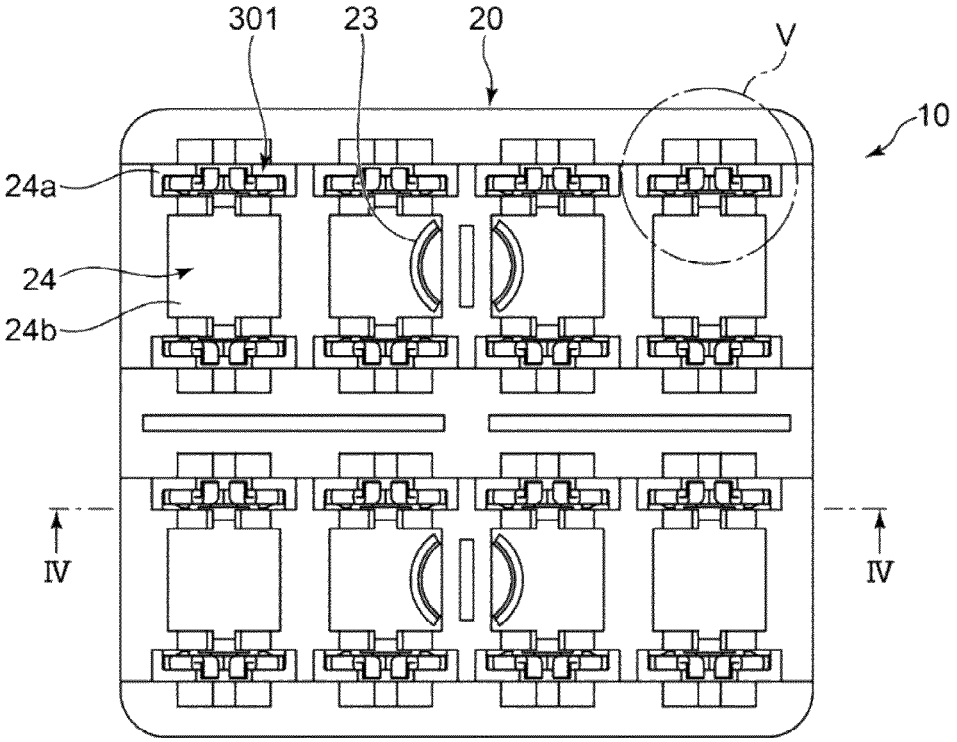
FIG. 2 is a plan view of the electrical connector illustrated in FIG. 1.
Figure 3:
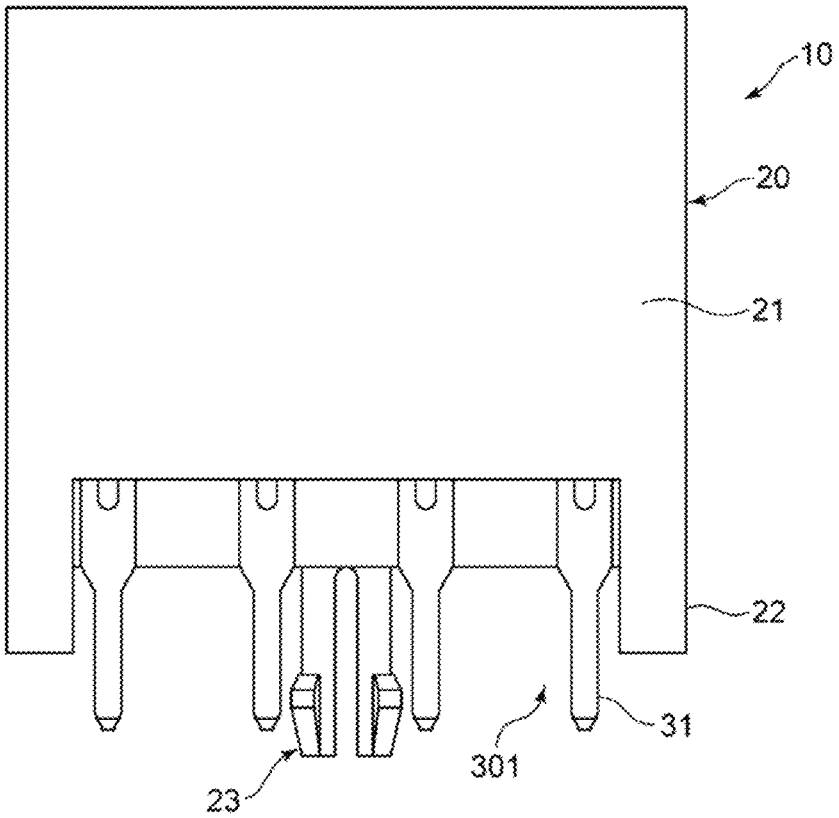
FIG. 3 is a front view of the electrical connector illustrated in FIG. 1.

An electrical connector according to a first embodiment of the present disclosure will be explained with reference to FIGS. 1-13.

An electrical connector 10 illustrated in FIGS. 1-5 is to electrically connect a fuse 100 which is to protect an electrical circuit against an overcurrent to an unillustrated printed board. The fuse 100 includes a fuse main part 102, and a pair of tabular connection terminals 101 protruding from both ends of the fuse main part 102 in the same direction. The tabular connection terminal 101 serves as a male connection terminal.

The electrical connector 10 is provided with an insulation housing 20 formed of an insulative material, and a connector terminal 301. The insulation housing 20 is formed of, for example, a resin.

The insulation housing 20 is formed in a substantially rectangular shape as viewed from the insertion side of the tabular connection terminal 101. The insulation housing 20 is provided with a housing main part 21, four support legs 22, and a fastening leg 23.

The support leg 22 protrudes from each corner of the bottom of the housing main part 21. The fastening leg 23 is to be inserted in the mounted printed board, and is applied to fasten the electrical connector 10. The fastening leg 23 is formed at the center of the bottom of the insulation housing 20. The fastening leg 23 has a pair of semi-cylindrical shapes facing with each other so as to form a cylindrical shape. The tip of the fastening leg 23 is formed with a wedge to be engaged with the open edge of a through-hole when inserted in the printed board. The insulation housing 20 employing the above structure is formed with eight terminal retaining rooms 24.

Each terminal retaining room 24 is formed with two terminal press-fit parts 24*a*, and a fuse insertion part 24*b*. The terminal press-fit part 24*a* has the pair of connector terminals 301 press-fitted therein in a manner facing with each other. The fuse insertion part 24*b* retains therein the fuse main part 102. The lower end part of the terminal press-fit part 24*a* is formed with a narrow-width part 24*c* (see FIG. 4). The narrow-width part 24*c* is to be engaged with the press-fit engage part of the connector terminal 301 to be press-fitted in from the bottom side of the insulation housing 20.

As illustrated in FIGS. 6-9, the connector terminal 301 is a fork terminal that has an entire contour formed in a Y-shape. The connector terminal 301 is formed by punching out a plated sheet material, and also bending thereto.

The connector terminal 301 includes a leg part 31, arm parts 32 (first arm part) and 32' (second arm part), an interconnection part 33, a contactor 34A (first contactor), and a contactor 34A' (second contactor).

The leg part 31 is to be inserted in the unillustrated printed board on which the electrical connector 10 is mounted. The leg part 31 protrudes from the bottom of the interconnection part 33. The leg part 31 is formed in a thin-needle shape. The leg part 31 is connected so as to carry a current with a wiring pattern formed on the printed board.

The pair of arm parts 32, 32' is provided at the interconnection part 33 so as to extend in the predefined direction. The direction in which the one arm part 32 (first arm part) extends is in parallel with the direction in which the other arm part 32' (second arm part) extends. In this embodiment, the arm parts 32, 32' are formed so as to extend along the lengthwise direction of the connector terminal 301.

The interconnection part 33 interconnects a one end 32*a* of the arm part 32 with a one end 32*a* of the arm part 32', and is formed in a V-shape or a fork shape. The interconnection part 33 is formed with a press-fit engagement part 331, and a wide-width part 332. The press-fit engagement part 331 and the wide-width part 332 are each a protruding part in a substantially triangular shape which protrudes from the side of the interconnection part 33.

Figure 4:
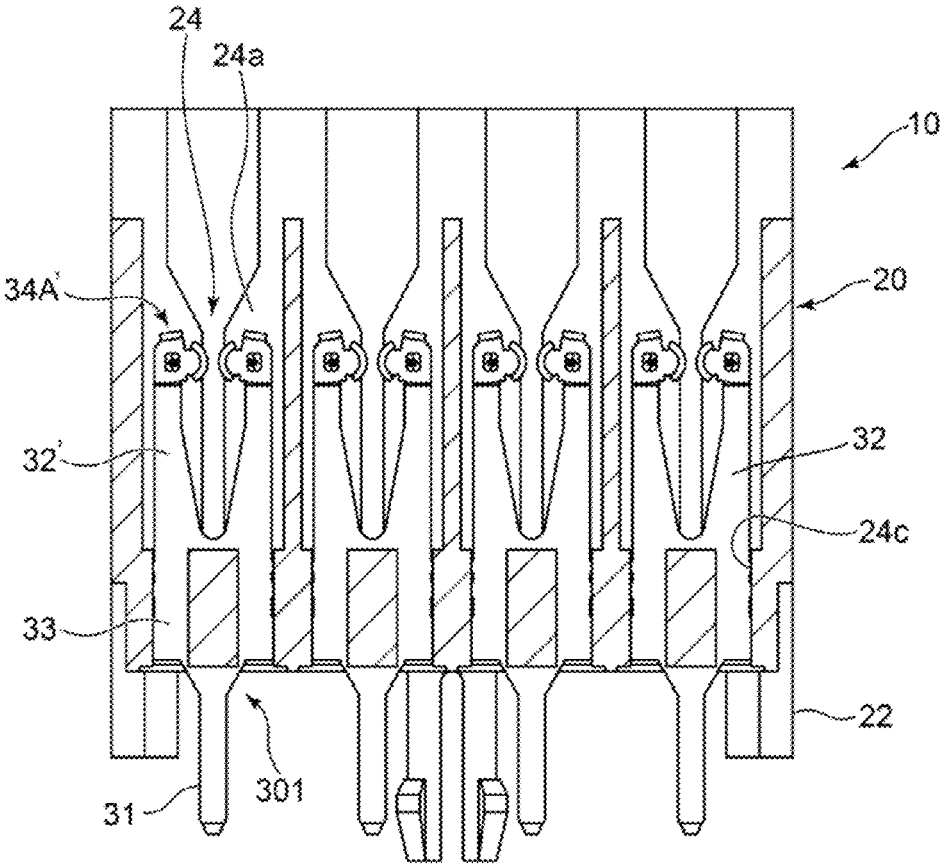
FIG. 4 is a cross-sectional view taken along a line IV-IV for the electrical connector illustrated in FIG. 2.
Figure 5:
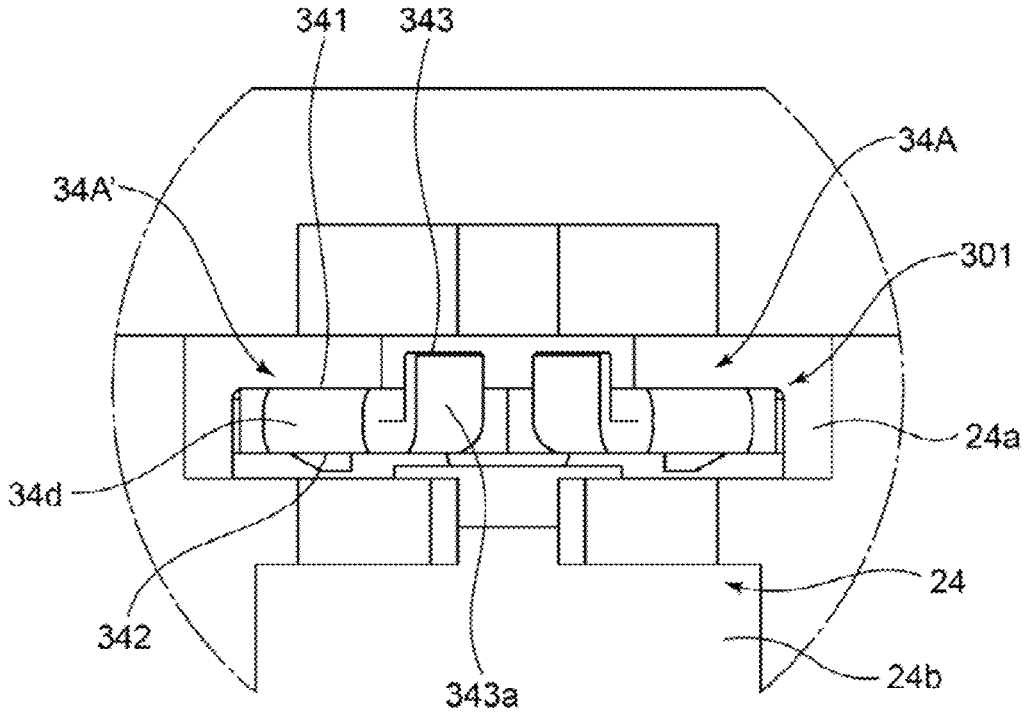
FIG. 5 is an enlarged view of a V-part in the electrical connector illustrated in FIG. 2.

The press-fit engagement part 331 is to be engaged with the terminal retaining room 24 (see FIG. 4). More specifically, when press-fitted in the terminal retaining room 24, the press-fit engagement part 331 is engaged with the narrow-width part 24*c* formed at the terminal retaining room 24 of the insulation housing 20.

The wide-width part 332 is a rectangular part protruding further outwardly relative to the press-fit engagement part 331. The wide-width part 332 is formed so as to be wider than the opening of the terminal retaining room 24. Hence, an excessive insertion of the connector terminal 301 into the terminal retaining room 24 is suppressed.

Figure 10A:
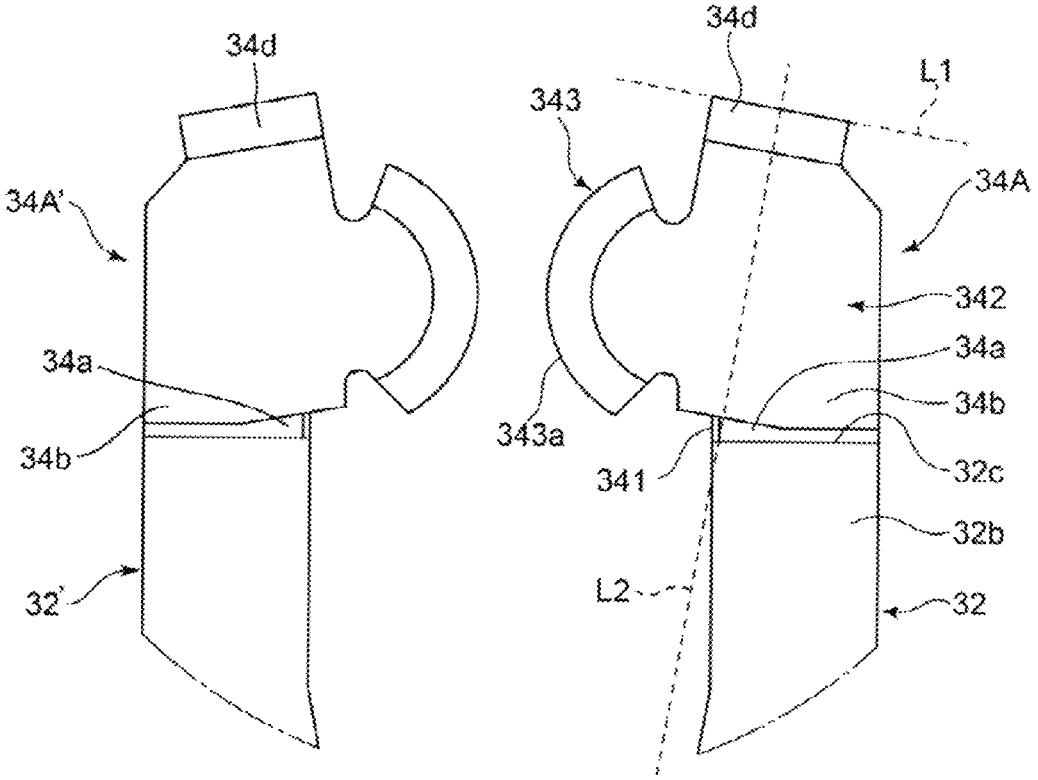
FIG. 10A is an enlarged view of a contactor of the connector terminal illustrated in FIG. 8.

As illustrated in FIG. 10A, the contactor 34A is formed from a piece of sheet. The sheet that forms the contactor 34A is a bent sheet which has the one end 34*a* of the contactor 34A connected to an other end 32*b* of the arm part 32, and which has an other end 34*b* laid over on the one end 34*a* with reference to a bent part 34*d* (first bent part) at the right side in FIG. 10A.

Likewise, the contactor 34A' is formed of a piece of sheet. The sheet that forms the contactor 34A' is a bent sheet which has the one end 34*a* of the contactor 34A' connected to an other end 32*b* of the arm 32', and which has an other end 34*b* laid over on the one end 34*a* with reference to a bent part 34*d* (second bent part) at the left side in FIG. 10A.

Figure 7:
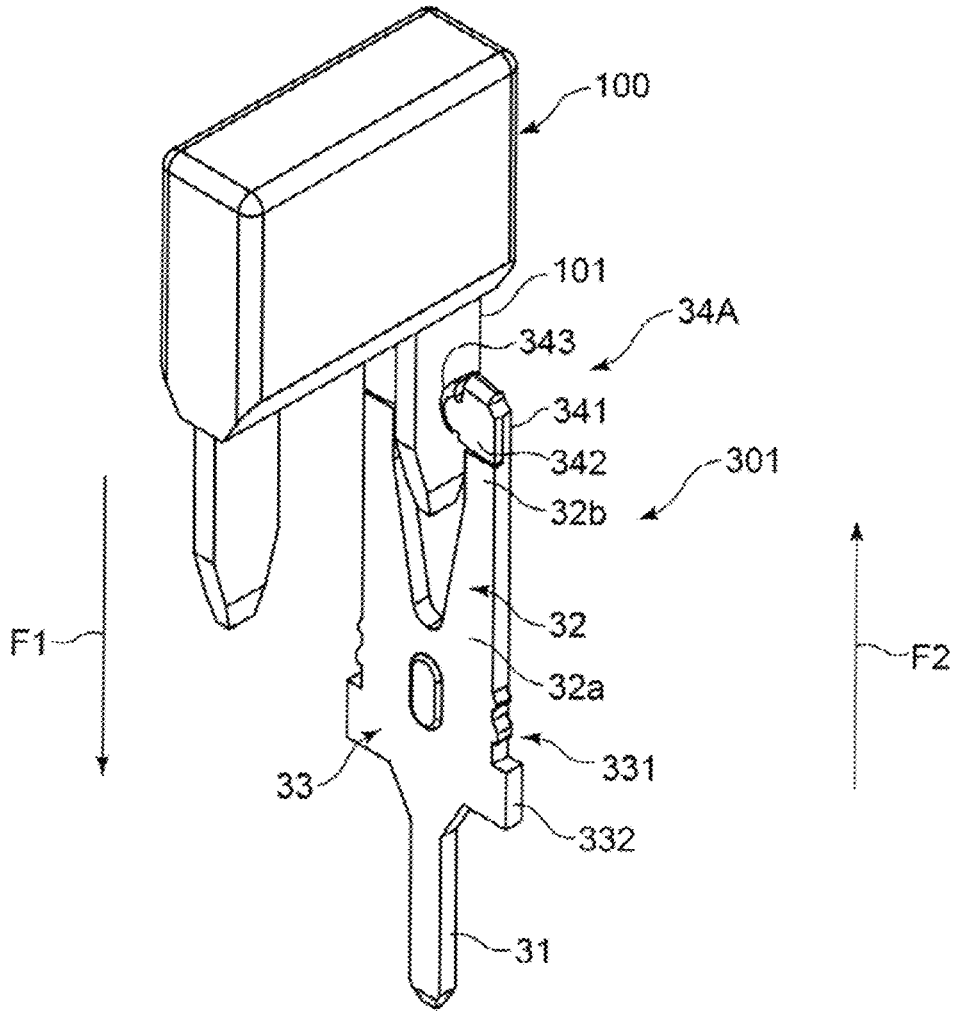
FIG. 7 is a perspective view with the fuse being inserted in the connector terminal illustrated in FIG. 6.
Figure 8:
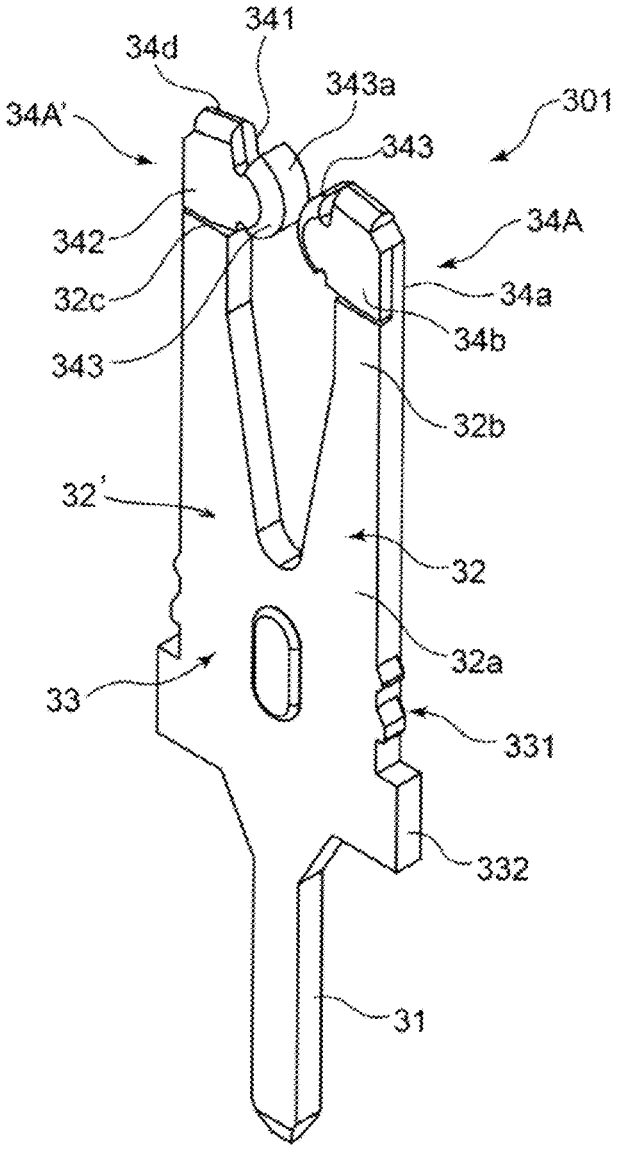
FIG. 8 is a perspective view of the connector terminal illustrated in FIG. 7.

As illustrated in FIG. 7, the pair of contactors 34A, 34A' is disposed on the arm parts 32, 32', respectively, so as to face with each other and to be in contact with the tabular connection terminal 101 (terminal component) inserted therebetween toward the interconnection part 33.

Each of the contactors 34A, 34A' includes a support part 341 (first support part, second support part), a bent part 34*d* (first bent part, second bent part), a fold-back part 342 (first fold-back part, second fold-back part), and a contact piece 343 (first contact piece, second contact piece).

The support part 341 extends in a removing direction F2 opposite to the inserting direction F1 of the tabular connection terminal 101 from the other end 32*b* of the arm part 32, 32'. The fold-back part 342 extends toward the other end 32*b* of the arm part 32, 32', from the support part 341 so as to be folded and laid over on the support part 341. The contact piece 343 is a part to be in contact with the tabular connection terminal 101.

Each support part 341 is formed with a circular-arc protruding part 341*p* (see FIG. 11) that extends toward the contact piece 343. The support part 341 has a thickness that is half of the thickness of the other end 32*b* of the arm part 32, 32'.

As illustrated in FIG. 10A, the bent part 34*d* that has the support part 341 and the fold-back part 342 folded and bent is formed so as to have a narrower width than that of the center of the support part 341 and that of the fold-back part 342 so as to facilitate folding and bending. The fold-back part 342 is formed so as to have the thickness that is half of the thickness of the other end 32*b* of the arm part 32.

A orthogonal line L2 that is orthogonal to a bending center line L1 of the bent part 34*d* of the contactor 34A intersects the arm 32' connected to the other contactor 34A' in the pair of contactors 34A, 34A'. In addition, the orthogonal line L2 orthogonal to the bending center line L1 of the bent part 34*d* of the contactor 34A' intersects the arm part 32 connected to the other contactor 34A in the pair of contactors 34A, 34A'.

The contact piece 343 is formed in a circular-arc surface shape that expands toward the inserted tabular connection terminal 101 in a manner matching the contour shape of the protruding part of the protruding part 341*p*. The contact piece 343 is formed with a contact surface 343*a* to be in contact with the tabular connection terminal 101.

Next, an explanation will be given of a method for manufacturing the connector terminal 301 of the electrical connector 10 according to the first embodiment of the present disclosure and employing the above structure with reference to FIGS. 11-13.

Figure 11:
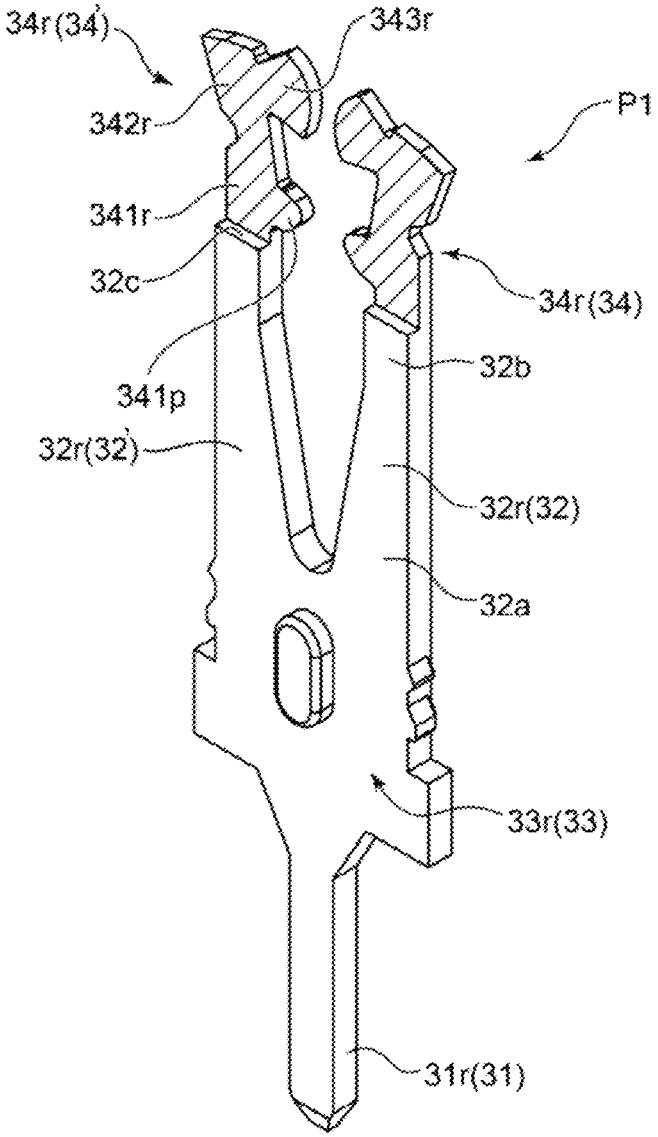
FIG. 11 is a diagram for explaining the manufacturing process of the connector terminal illustrated in FIG. 8, and is a perspective view illustrating a sheet metal having undergone a punching and then crushing on a contactor part forming area.

As illustrated in FIG. 11, first, a worker who attempts to manufacture the connector terminal 301 punches out the sheet metal that has a surface having undergone plating by pressing using a die, thereby forming a sheet metal P1 (first process). The sheet metal P1 is provided with a leg part forming area 31*r* that will be the leg part 31, a pair of arm part forming areas 32*r* that will be the arm parts 32, 32', an interconnection part forming area 33*r* which is extended from the arm part forming areas 32*r*, and which will be the interconnection part 33, and a pair of contactor part forming areas 34*r* which is extend from the respective arm part forming areas 32*r*, and which will be contactors 34A, 34A'.

In addition, each contactor area forming area 34*r* is provided with a support part forming area 341*r* that will be a support part 341, a fold-back part forming area 342*r* that will be a fold-back part 342, and a contact piece forming area 343*r* that will be the contact piece 343.

Next, the worker crushes the contactor part forming area 34*r* in such a way that the thickness of the contactor part forming area 34*r* becomes half of the thickness of the arm part forming area 32*r*. This crushing makes the thickness of the contactor part forming area 34*r* of the sheet metal P1 thinner than those of the arm part forming area 32*r*, interconnection part forming area 33*r*, and leg part forming area 31*r*. Consequently, an unleveled part 32*c* is formed at the boundary between the contactor part forming area 34*r* and the arm part forming area 32*r*.

Figure 12:
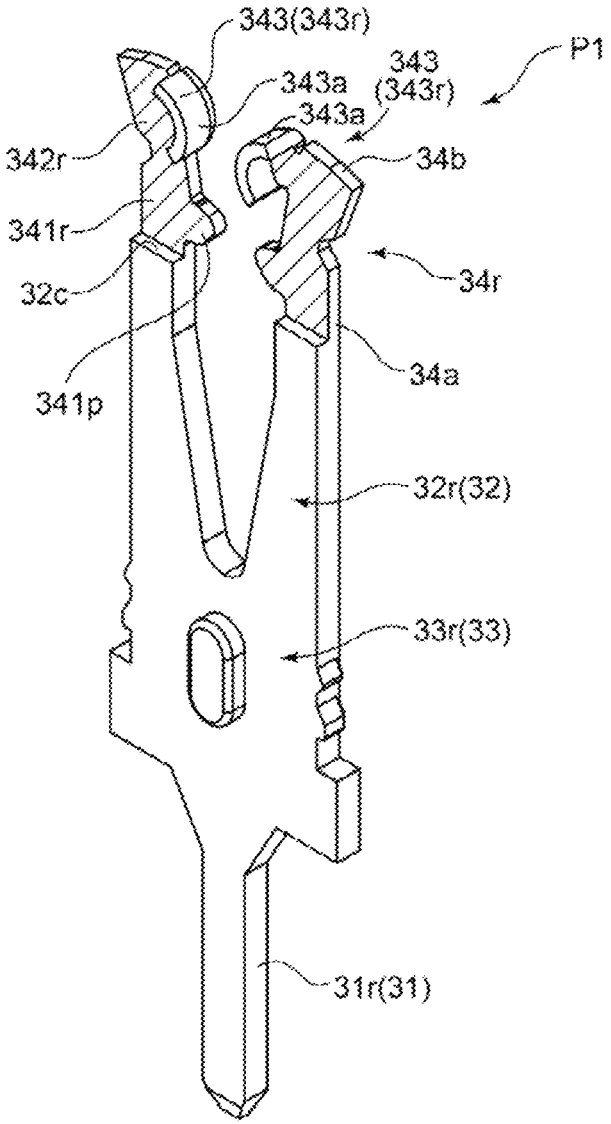
FIG. 12 is a diagram for explaining the manufacturing process of the connector terminal subsequent to FIG. 11, and is a perspective view illustrating a contact piece bent by ironing bending.

Subsequently, as illustrated in FIG. 12, the worker applies ironing bending on the contact piece forming area 343*r* to cause the pair of contact piece forming areas 343*r* to face with each other (second process). At this time, the contact surface 343*a* of the contact piece 343 is bent so as to be a circular-arc surface that expands in the facing direction.

Figure 13:
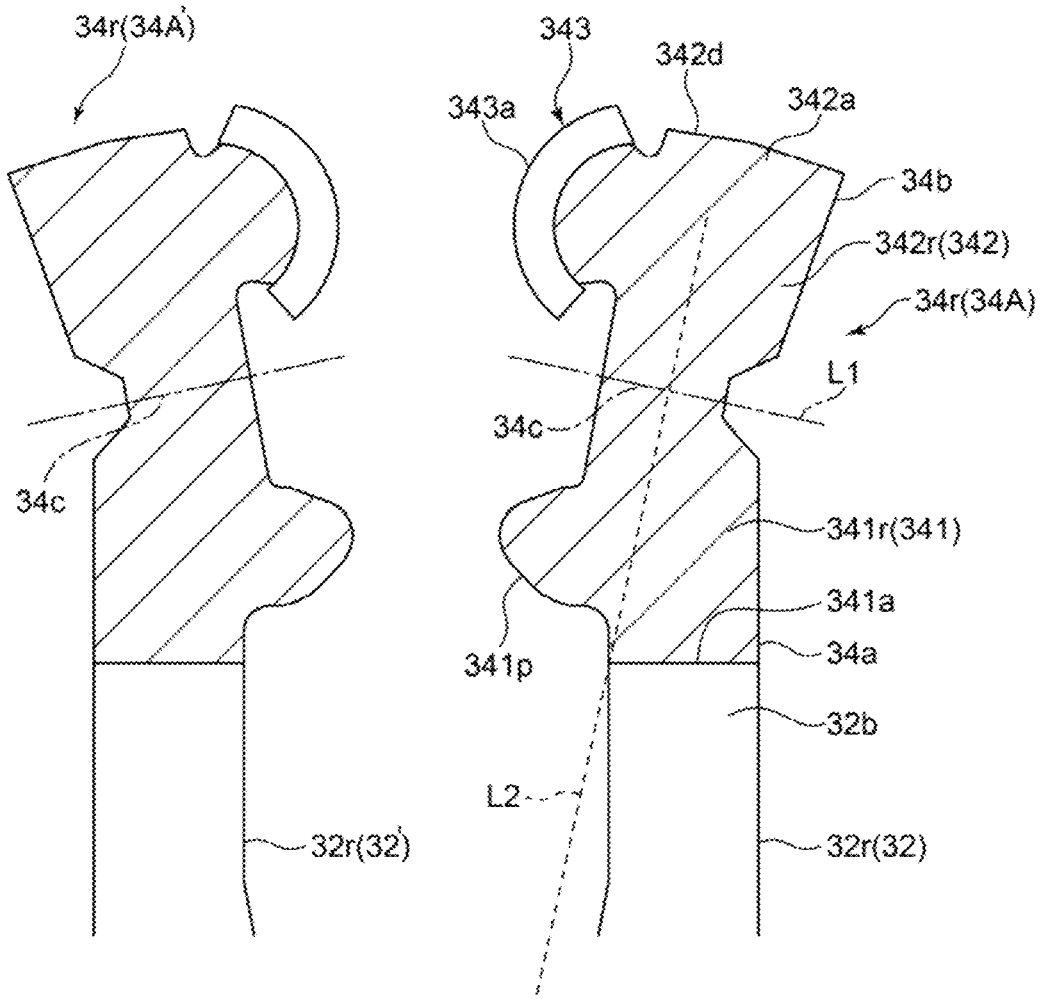
FIG. 13 is an enlarged diagram of the contactor part forming area of the sheet metal illustrated in FIG. 12.

Next, as illustrated in FIG. 13, the worker folds the other end 34*b* of each contactor part forming area 34*r* so as to be laid over on the one end 34*a*. More specifically, with the linear boundary part between the support part forming area 341*r* and the fold-back part forming area 342*r* being as a fold-back line 34*c*, a one end 342*a* of the fold-back part forming area 342*r* that will be the fold-back part 342 is folded so as to be laid over on a one end 341*a* of the support part 341.

At this time, the worker folds the other end 34*b* of the contactor part forming area 34*r* so as to be laid over on the one end 34*a* and cause the orthogonal line L2 to the bending center line L1 at the bent part 34*d* (see FIG. 10A) of the contactor 34A to intersect the arm part 32'.

In addition, the worker folds the other end 34*b* of the contactor part forming area 34*r* so as to be laid over on the one end 34*a* and cause the orthogonal line L2 to the bending center line L1 at the bent part 34*d* (see FIG. 10A) of the contactor 34A' to intersect the arm part 32 (third process).

As explained above, by folding the fold-back part 342 so as to be laid over on the support part 341, the contactors 34A, 34A' become close to each other.

Note that in the above manufacturing method, the third process is executed after the second process, but may be executed prior to the second process. Through the above processes, the manufacturing of the connector terminal 301 illustrated in FIG. 8 completes.

Next, how to apply the electrical connector 10 according to the first embodiment of the present disclosure will be explained with reference to FIGS. 6, 7.

As illustrated in FIG. 7, the contact piece 343 is formed so as to protrude in the orthogonal direction to the inserting direction F1 and the removing direction F2 from the fold-back part 342.

Hence, when the tabular connection terminal 101 of the fuse 100 is inserted in the connector terminal 301, the contact surface 343*a* which is not a broken surface produced at the time of punching-out but is a smooth plated surface becomes in contact with the tabular connection terminal 101.

Accordingly, a damage to the tabular connection terminal 101, and a shaving thereof are suppressed. In addition, since the contact surface 343*a* is a plated surface, the friction between the contact surface 343*a* and the tabular connection terminal 101 is reduced, and thus a smooth insertion and removal are enabled.

Figure 6:
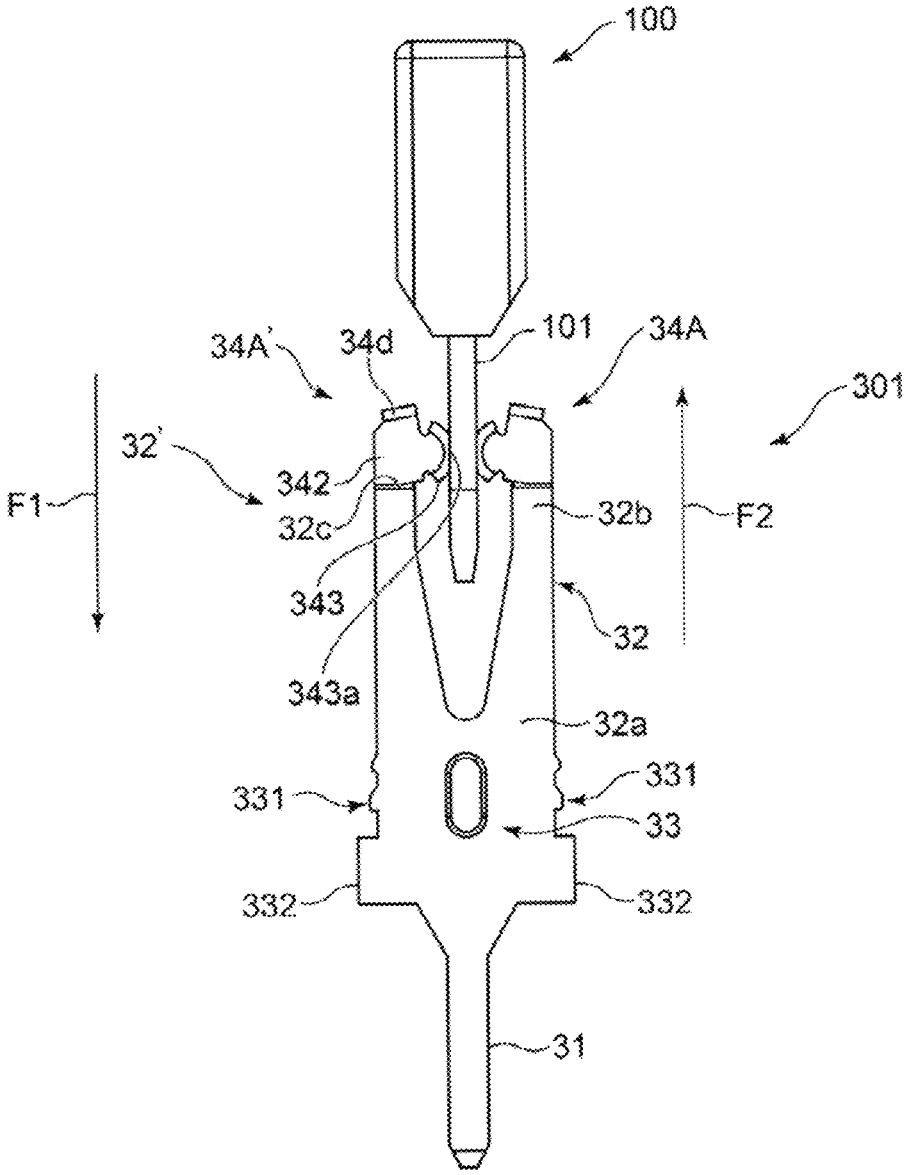
FIG. 6 is a front view with the fuse being inserted in a connector terminal of the electrical connector illustrated in FIG. 1.

Still further, as illustrated in FIG. 6, since the contact piece 343 is curved in a circular-arc shape along the tabular connection terminal 101, the friction relative to the tabular connection terminal 101 can be reduced while firmly holding the tabular connection terminal 101.

As explained above, according to the connector terminal 301 in the first embodiment, the orthogonal line L2 to the bending center line L1 of the bent part 34*d* of the contactor 34A intersects the other contactor 34A'. In addition, the orthogonal line L2 to the bending center line L1 of the bent part 34*d* of the contactor 34A' intersects the other contactor 34A. Hence, the smooth contact surface 343*a* of the contact piece 343 having undergone the plating can be shifted toward the tabular connection terminal 101 inserted toward the interconnection part 33.

Accordingly, the connector terminal 301 is capable of being in contact with and fastening the male connection terminal at a high contact load, and thus the connection reliability to the tabular connection terminal 101 that is the male connection terminal (terminal component) is improved. In addition, according to the connector terminal 301, the degree of freedom for designing of the connector terminal 301 is improved by adjusting the gap between the contactor 34A and the contactor 34A'.

In addition, according to this first embodiment, the direction in which the arm part 32 extends is in parallel with the direction in which the arm part 32' extends. Hence, the orthogonal line L2 to the bending center line L1 of the bent part 34*d* of the one contactor 34A, 34A' forms the contactor 34A, 34A' intersecting the arm part 32, 32' connected to the other contactor 34A', 34A. Consequently, the contact piece 343 provided at the fold-back part 342 can be shifted toward the tabular connection terminal 101.

Still further, according to the first embodiment, the contact piece 343 is formed in a circular-arc surface that expands toward the tabular connection terminal 101. Hence, the gap between the contact pieces 343 spreads toward the removing direction F2 of the tabular connection terminal 101. This facilitates an insertion of the tabular connection terminal 101 between the contact pieces 343. Yet still further, since the contact piece 343 is a circular-arc surface that expands toward the tabular connection terminal 101 in a manner matching the contour shape of the protruding part of the protruding part 341*p*, the protruding part 341*p* and the contact piece 343 become integral with each other, and the protruding part 341*p* suppresses a deformation of the contact piece 343. This enhances the rigidity of the contactor 34A, 34A'.

Moreover, according to this first embodiment, the thickness of the support part 341 and that of the fold-back part 342 are thinner than those of the other ends 32*b* of the arm parts 32, 32'. Hence, the total thickness when the fold-back part 342 is laid over on the support part 341 is made thin. In particular, since the thickness of the support part 341 and that of the fold-back part 342 are half of the thickness of the other end 32*b* of the arm part 32, the thickness when the fold-back part 342 is laid over on the support part 341 can be equal to the thicknesses of the arm part 32, 32'.

Figure 9:
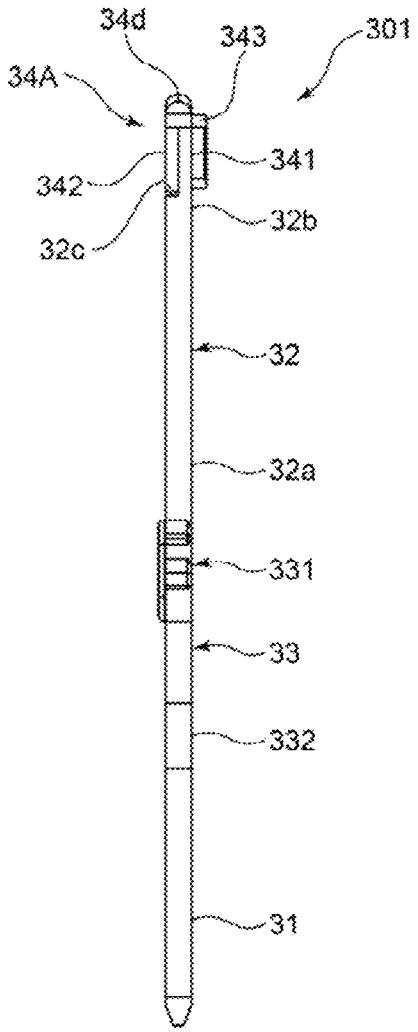
FIG. 9 is a side view of the connector terminal illustrated in FIG. 8.

Furthermore, as illustrated in FIGS. 9, 10A, when the fold-back part 342 is bent, the end surface of the fold-back part 342 faces the end face of the unleveled part 32*c*, and becomes close thereto.

Figure 10B:
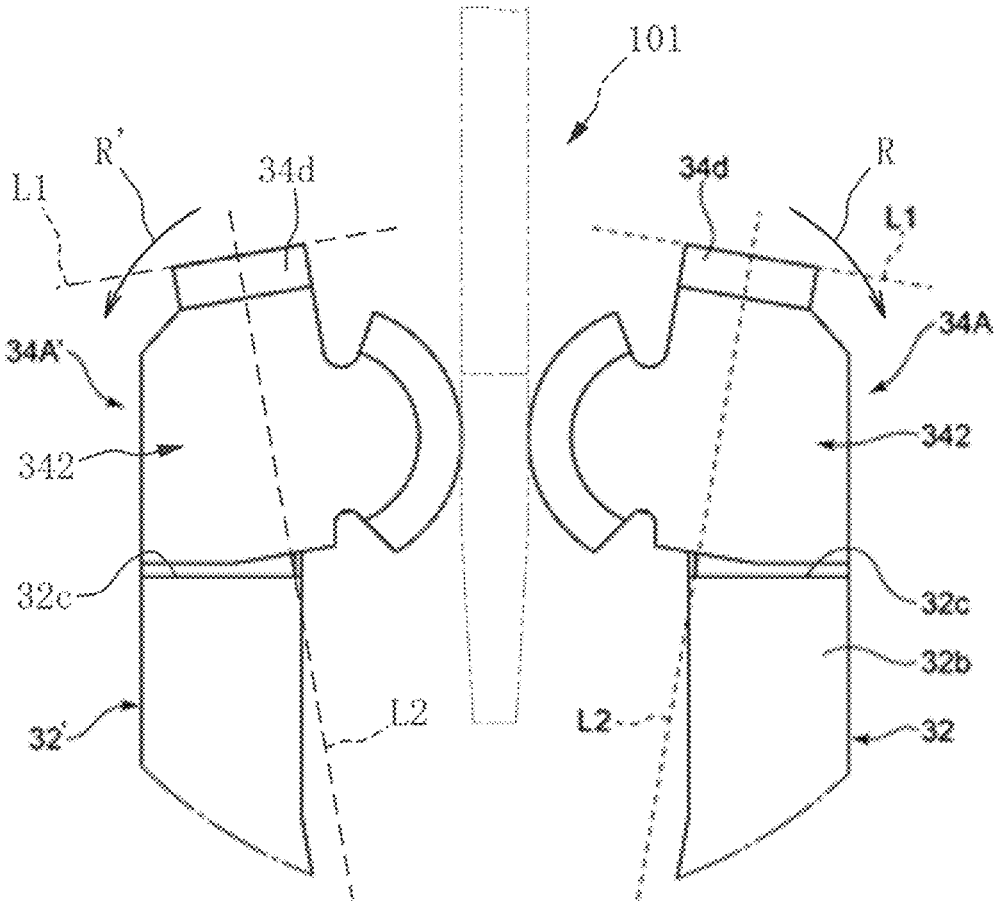
FIG. 10B is a diagram illustrating how to apply the connector terminal.

In this state, as illustrated in FIG. 10B, when the tabular connection terminal 101 is inserted in between the pair of contactors 34A, 34A', each fold-back part 342 attempts to warp in an outward direction R, R', opposite to the tabular connection terminal 101.

However, since the fold-back part 342 contacts the unleveled part 32*c*, the outward warpage of the fold-back part 342 is restricted.

Since the support part 341 is formed with the protruding part 341*p*, when the contact pieces 343 hold therebetween the tabular connection terminal 101, even if the contact piece 343 is relatively pushed by the tabular connection terminal 101, the protruding part 341*p* supports the contact piece 343 from the back side. Therefore, the contact pieces 343 are capable of firmly holding therebetween the tabular connection terminal 101.

Second Embodiment

A connector terminal according to a second embodiment of the present disclosure will be explained with reference to FIGS. 14-17. Note that in order to facilitate understanding, an XYZ coordinate system is defined, and will be referred as appropriate.

Figure 14:
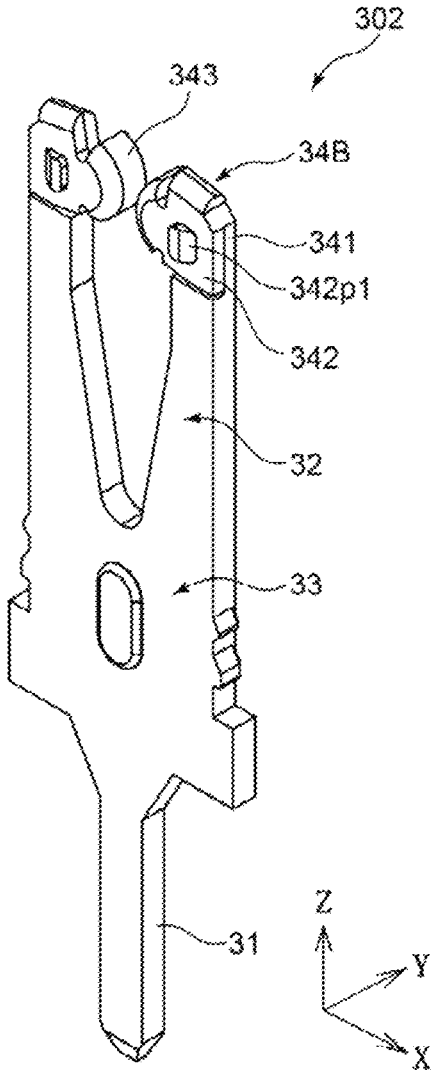
FIG. 14 is a perspective view illustrating a connector terminal according to a second embodiment of the present disclosure.
Figure 15:
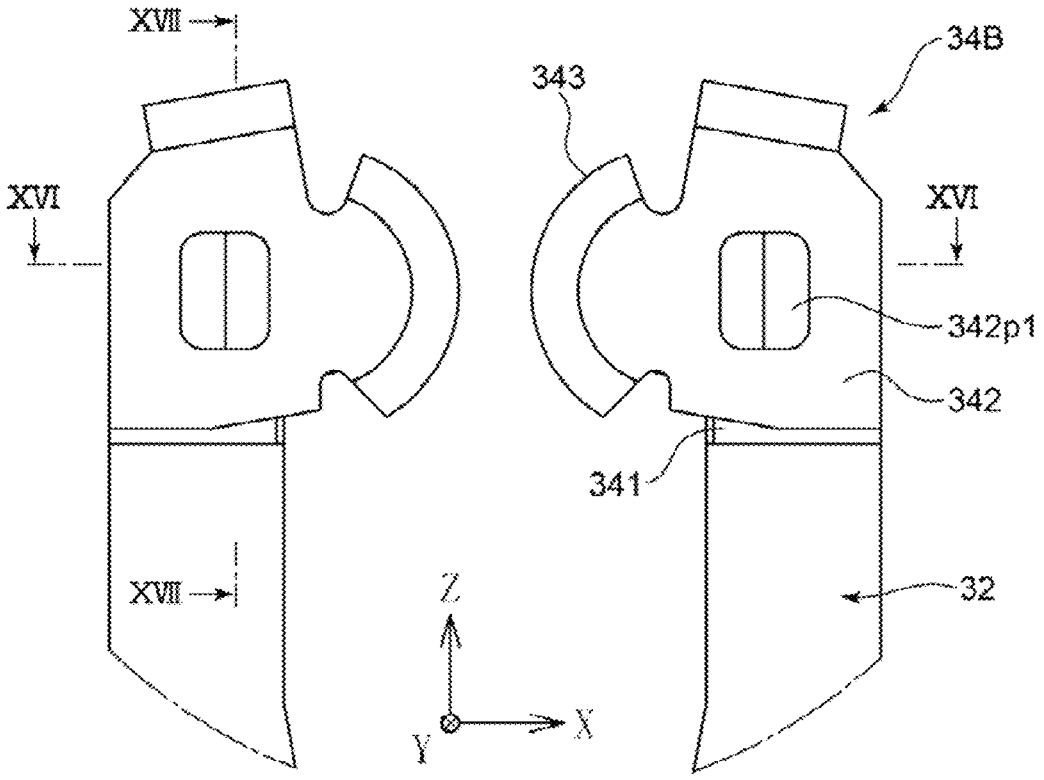
FIG. 15 is an enlarged view of a contactor of the connector terminal illustrated in FIG. 14.

As illustrated in FIGS. 14, 15, a connector terminal 302 according to the second embodiment has respective back side surfaces (surfaces at +Y side) of contactors 34B having undergone punching. This punching forms a second convexity part 342*p*1 at the connector terminal 302 protruding from the front surface side (surface at −Y side). What the connector terminal 302 differs from the connector terminal 301 of the first embodiment is that the second convexity part 342*p*1 is formed.

Figure 16:
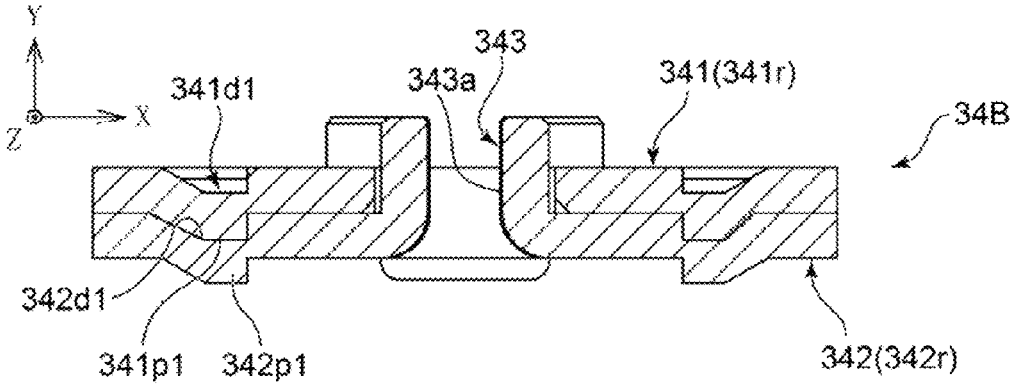
FIG. 16 is a cross-sectional view taken along a line XVI-XVI for the contactor illustrated in FIG. 15.
Figure 17:
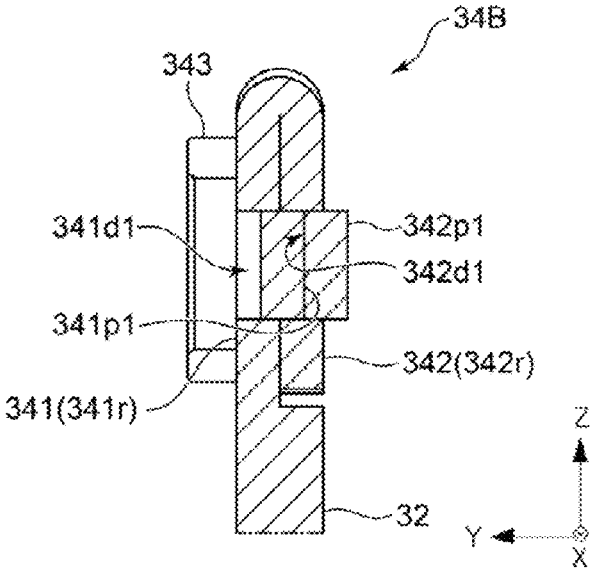
FIG. 17 is a cross-sectional view taken along a line XVII-XVII for the contactor illustrated in FIG. 15.

As illustrated in FIGS. 16, 17, a first concavity part 341*d*1 is formed in the one surface of the support part 341 of the contactor 34B in the connector terminal 302 at the +Y side (opposite surface to fold-back-part 342 side). In addition, a first convexity part 341*p*1 corresponding to the first concavity part 341*d*1 is formed in the other surface of the support part 341 at the −Y side.

A second concavity part 342*d*1 is formed on the one surface of the fold-back part 342 at the +Y side (surface at support-part-341 side). In addition, a second convexity part 342*p*1 corresponding to the second concavity part 342*d*1 is formed on the other surface at the −Y side.

Still further, the first convexity part 341*p*1 and the second concavity part 342*d*1 are engaged with each other.

The first concavity part 341*d*1 and the first convexity part 341*p*1, and, the second concavity part 342*d*1 and the second convexity part 342*p*1 can be formed by punching toward the fold-back part forming area 342*r* from the one surface side of the support part forming area 341*r* (see FIGS. 13 and 14) that will be the support part 341 (fourth process).

As explained above, according to the second embodiment, the first convexity part 341*p*1 and the second concavity part 342*d*1 are engaged with each other. Hence, the support part 341 of the contactor 34B and the fold-back part 342 can be integrated in a manner intimately in contact with each other. This enables an efficient current flow which flows in the fold-back part 342 to the support part 341. Consequently, the rated current for the connector terminal 302 can be increased.

In addition, when the tabular connection terminal 101 of the fuse 100 is inserted or removed, the fold-back part 342 is prevented from moving apart from the support part 341.

Third Embodiment

A connector terminal according to the third embodiment of the present disclosure will be explained with reference to FIGS. 18-20. Note that in the third embodiment, a cross-sectional view that traverses the pair of contactors is the same as FIG. 16. Hence, illustration thereof is omitted. In addition, in order to facilitate understanding, an XYZ coordinate system is defined, and will be referred as appropriate.

Figure 18:
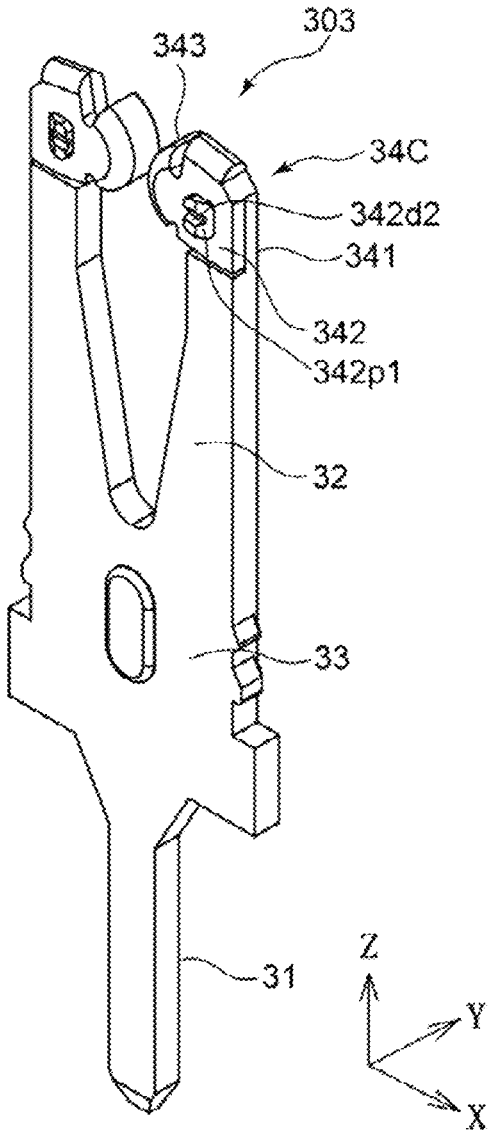
FIG. 18 is a perspective view illustrating a connector terminal according to a third embodiment of the present disclosure.
Figure 19:
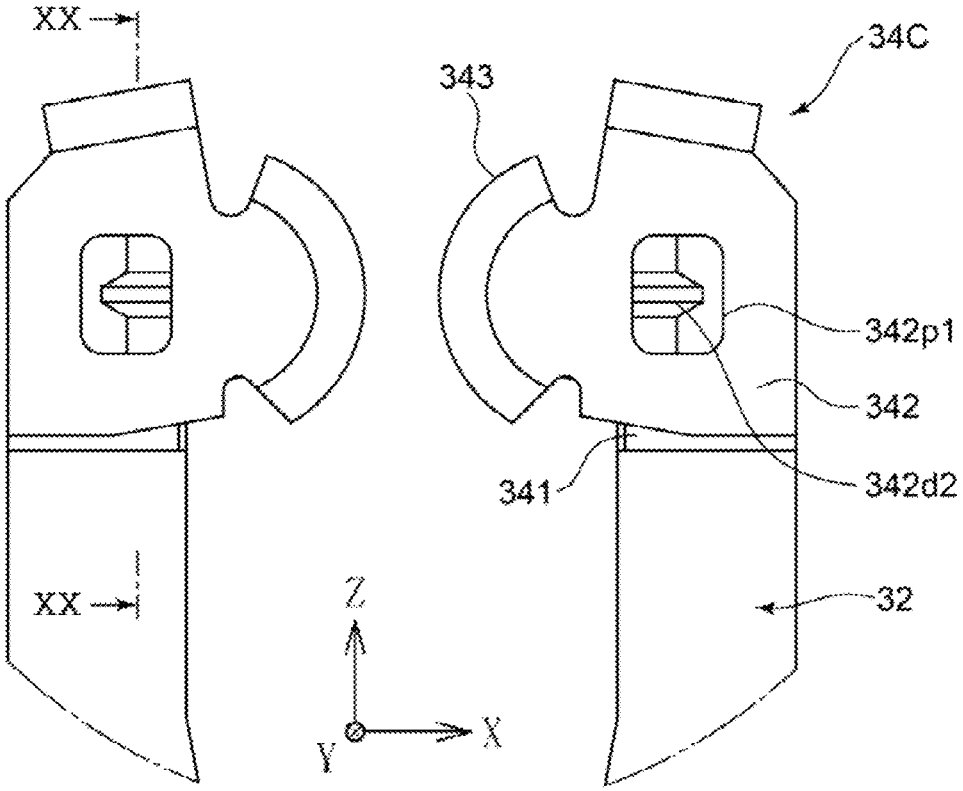
FIG. 19 is an enlarged view of a contactor of the connector terminal illustrated in FIG. 18.

As illustrated in FIGS. 18, 19, what a connector terminal 303 according to the third embodiment differs from the connector terminal 302 of the second embodiment is that punching is performed on the front surface of the second convexity part 342*p*1.

Figure 20:
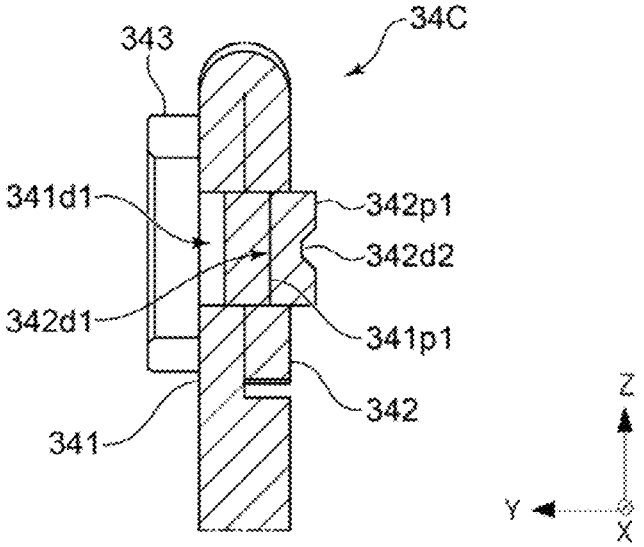
FIG. 20 is a cross-sectional view taken along a line XX-XX for the contactor illustrated in FIG. 19.

As illustrated in FIGS. 18-20, like the second embodiment, the first concavity part 341*d*1 is formed in the one surface of the support part 341 of a contactor 34C in the connector terminal 303 at the +Y side (opposite surface to fold-back-part-342 side). In addition, the first convexity part 341*p*1 corresponding to the first concavity part 341*d*1 is formed on the other surface of the support part 341 at the −Y side.

The second concavity part 342*d*1 is formed in the one surface of the fold-back part 342 at the +Y side (surface at support-part-341 side). In addition, the second convexity part 342*p*1 corresponding to the second concavity part 342*d*1 is formed on the other surface at the −Y side.

Still further, the first convexity part 341*p*1 and the second concavity part 342*d*1 are engaged with each other.

Yet still further, a third concavity part 342*d*2 is formed in the second convexity part 342*p*1.

This third concavity part 342*d*2 can be formed by punching that is a punching work with a small diameter on the contactor 34B of the connector terminal 303 according to the third embodiment toward the second convexity part 342*p*1 from the other surface of the fold-back part 342 from the −Y side (fifth process).

As explained above, according to the third embodiment, by performing punching toward the second convexity part 342*p*1, the fold-back part 342 is depressed against the support part 341, and thus the support part 341 and the fold-back part 342 can be further intimately in contact with each other.

Fourth Embodiment

A connector terminal according to a fourth embodiment of the present disclosure will be explained with reference to FIG. 21. In addition, in order to facilitate understanding, an XYZ coordinate system is defined, and will be referred as appropriate.

Note that in the fourth embodiment, the perspective view as viewed from the fold-back-part side is the same as FIG. 18, and the cross-sectional view that traverses the pair of contactors is the same as FIG. 16. Hence, illustrations thereof are omitted.

Figure 21:
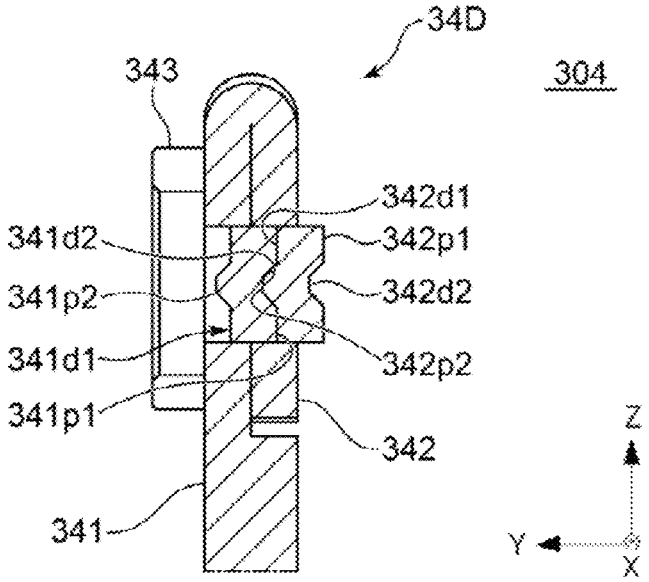
FIG. 21 is a cross-sectional view of a contactor of a connector terminal according to a fourth embodiment of the present disclosure.

As illustrated in FIG. 21, the first concavity part 341*d*1 is formed in the one surface of the support part 341 of a contactor 34D in a connector terminal 304 at the +Y side (opposite surface to fold-back-part-342 side). In addition, the first convexity part 341*p*1 corresponding to the first concavity part 341*d*1 is formed on the other surface of the support part 341 in the −Y side.

The second concavity part 342*d*1 is formed in the one surface of the fold-back part 342 at the +Y side (surface at support-part-341 side). In addition, the second convexity part 342*p*1 corresponding to the second concavity part 342*d*1 is formed on the other surface.

Still further, the first convexity part 341*p*1 and the second concavity part 342*d*1 are engaged with each other.

Yet still further, a third concavity part 342*d*2 is formed in the second convexity part 342*p*1. Moreover, a third convexity part 342*p*2 corresponding to the third concavity part 342*d*2 is formed on the second concavity part 342*d*1.

The first convexity part 341*p*1 is formed with a fourth concavity part 341*d*2. In addition, a fourth convexity part 341*p*2 corresponding to the fourth concavity part 341*d*2 is formed on the first concavity part 341*d*1.

Still further, the third convexity part 342*p*2 and the fourth concavity part 341*d*2 are engaged with each other.

The third concavity part 342*d*2 and the third convexity part 342*p*2, and, the fourth concavity part 341*d*2 and the fourth convexity part 341*p*2 can be formed by punching that is a further punching work with a small diameter on the contactor 34B of the connector terminal 303 in the third embodiment toward the second convexity part 342*p*1 from the other surface of the fold-back part 342 (fifth process).

As explained above, according to the fourth embodiment, the first convexity part 341*p*1 and the second concavity part 342*d*1 that are the convexity and concavity formed at the respective opposing surfaces of the support part forming area 341*r* and the fold-back part forming area 342*r* are engaged with each other, and the third convexity part 342*p*2 and the fourth concavity part 341*d*2 which are directed in the opposite directions and formed in the foregoing convexity and concavity are further formed and engaged with each other. Hence, the contactor 34D is made further integrated, and the support part 341 and the fold-back part 342 are further intimately in contact with each other in comparison with the contactor 34B of the second embodiment and the contactor 34C of the third embodiment.

Therefore, the connector terminal 304 is capable of having an increased rated current, and the strength of the fold-back part 342 when the tabular connection terminal 101 is inserted and removed is further enhanced.

In addition, the connector terminal according to the present disclosure is connectable to not only the fuse 100 illustrated in, for example, FIGS. 1 and 7, but also various terminal components of electric and electronic devices, such as a tub terminal, a bus bar, and a printed board.

Figure 22:
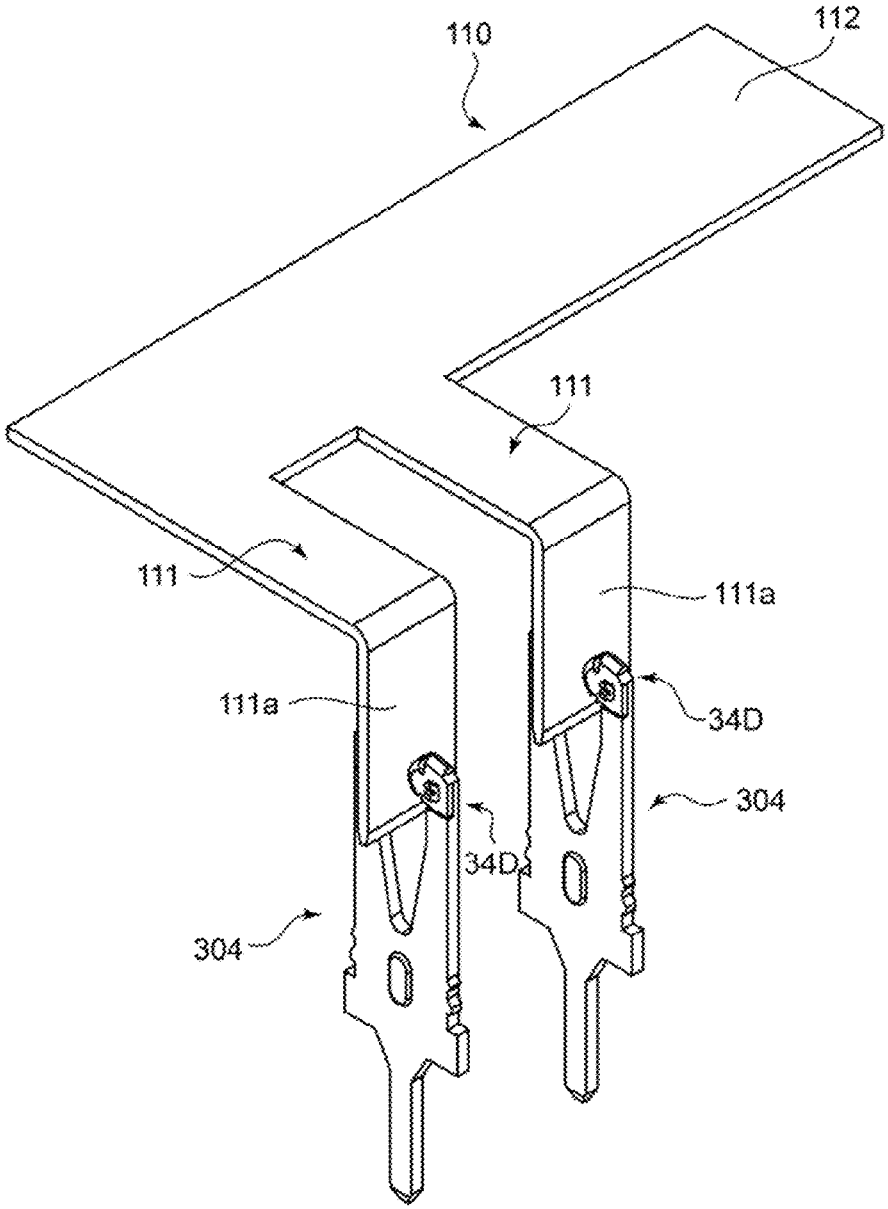
FIG. 22 is a perspective view illustrating a state in which a bus bar is connected to the contactor of the connector terminal according to the fourth embodiment.

FIG. 22 illustrates the connector terminal 304 of the fourth embodiment connected to a bus bar.

As illustrated in FIG. 22, a bus bar 110 is formed of a conductive sheet metal in an F-shape that includes two branches 111 with respective tips bent in an L-shape and becoming terminal parts 111*a*, and a stem 112 which interconnects the branches 111 with each other and which extends in one direction.

The two connector terminals 304 are disposed side by side in such a way that the directions of the pair of disposed contactors 34D become in parallel with an unillustrated insulation housing. The terminal part 111*a* of the bus bar 110 is in contact with the two contactors 34D of each connector terminals 304 so as to be held therebetween.

As explained above, although the bus bar 110 is applied, the connector terminal 304 has the pair of contactors 34D which is capable of contacting and fastening the terminal part 111*a* of the branch 111 at a high contact load.

Figure 23:
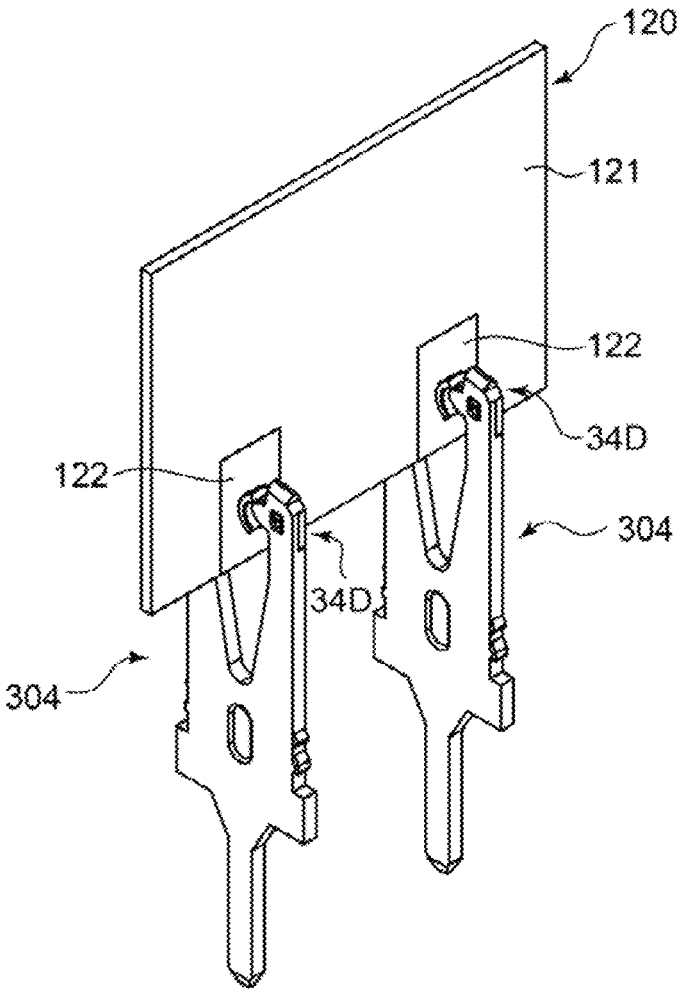
FIG. 23 is a perspective view illustrating a state in which a printed board is connected to the contactor of the connector terminal according to the fourth embodiment.

FIG. 23 illustrates the connector terminal 304 of the fourth embodiment connected to a printed board.

A printed board 120 illustrated in FIG. 23 includes a board main part 121 (insulation board), and two terminal parts 122. The terminal part 122 is formed of a thin metal film (wiring pattern).

Like the case illustrated in FIG. 22, the two connector terminals 304 is disposed side by side in such a way that the directions of the pair of disposed contactors 34D are in parallel with the unillustrated insulation housing. The terminal part 122 of the printed board 120 is in contact with the contactors 34D of the two connector terminals 304 so as to be held therebetween.

As explained above, according to the connector terminal 304, even if the printed board 120 is applied, the pair of contactors 34D are capable of being in contact with and fastening the terminal part 122 of the printed board 120 at a high contact load.

In addition, the leg part 31 of the connector terminal 301-304 according to the first to fourth embodiments can be connected to not only the printed board but also a terminal, a cable, and the like.

Figure 24:
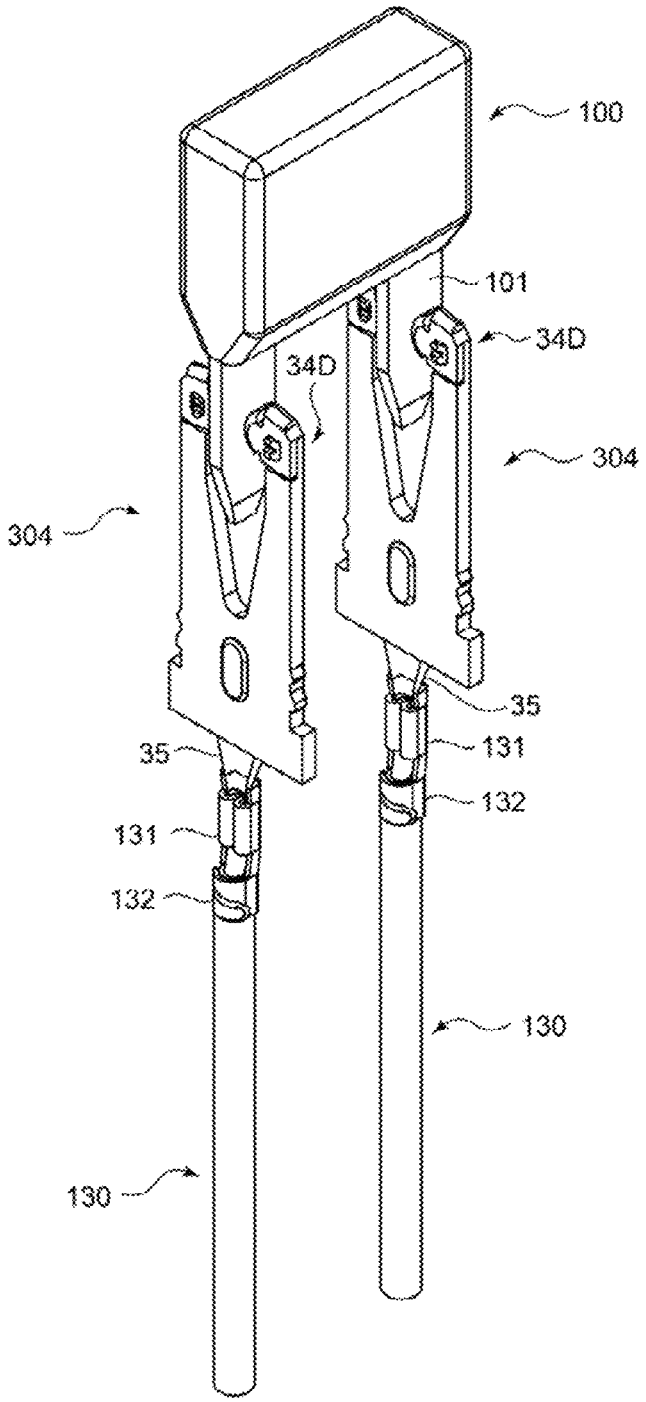
FIG. 24 is a perspective view illustrating a state in which a cable is connected to a leg part of the connector terminal according to the fourth embodiment.
Figure 25:
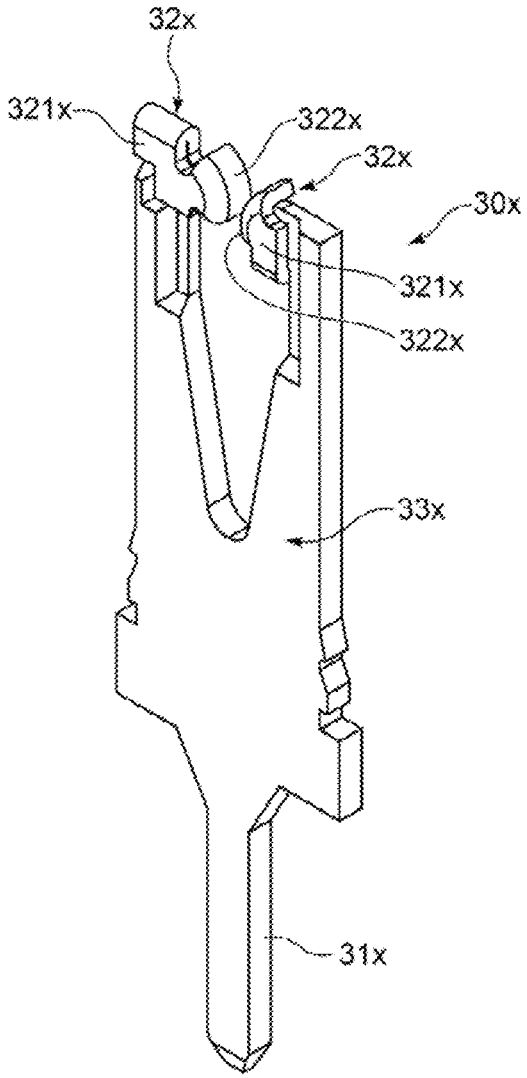
FIG. 25 is a perspective view illustrating a conventional connector terminal.

FIG. 24 illustrates the connector terminal 304 of the fourth embodiment which has the contactor 34D connected to the fuse 100, and has a leg part 35 connected to a cable.

Attached to each leg part 35 illustrated in FIG. 24 are a wire barrel 131, and an insulation barrel 132. The wire barrel 131 attaches and fastens, with pressure, the wire core exposed from the insulation covering of the cable 130. The insulation barrel 132 grasps the outer circumference of the insulation covering of the cable 130. By crimping the cable 130 to the leg part 35, the cable 130 is fastened to the connector terminal 304.

As explained above, by connecting the cable 130 to the connector terminal 304, the cable 130 can be electrically connected to the fuse 100.

Note that in FIGS. 22, 23, although the connector terminal 304 according to the fourth embodiment is connected to the bus bar 110 and the printed board 120, the connector terminal 301 of the first embodiment to the connector terminal 303 of the third embodiment are also capable of accomplishing the same advantageous effects.

In addition, although the cable 130 is connected to the leg part 35 of the connector terminal 304 in FIG. 24, the connector terminal 301 of the first embodiment to the connector terminal 303 of the third embodiment are also capable of being connected to the cable 130 by replacing the leg part 31 to the leg part 35.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The connector terminal, the electrical connector, and the method for manufacturing the connector terminal of the present disclosure are suitable for interconnecting having a terminal component press-fitted and fastened between a pair of contactors.

What is claimed is:

1. A connector terminal comprising:

a first arm part and a second arm part both extending in a predefined direction;

an interconnection part interconnecting a first end of the first arm part with a first end of the second arm part, and formed in a two-way branched shape;

a first contactor formed of a piece of sheet which has a first end connected to a second end of the first arm part, and which is in a bent shape so as to have the first end laid over on a second end of the sheet with reference to a first bent part that is an opposite side to a side where the first end of the sheet and the second end thereof are present, the first contactor being in contact with a terminal component inserted toward the interconnection part; and a second contactor formed of a piece of sheet which has a first end connected to a second end of the second arm part, and which is in a bent shape so as to have the first end laid over on a second end of the sheet with reference to a second bent part that is an opposite side to a side where the first end of the sheet and the second end thereof are present, the second contactor being in contact with the terminal component inserted toward the interconnection part, and the second contactor facing the first contactor, wherein an orthogonal line to a bending center line of the first bent part intersects the second arm part.

2. The connector terminal according to claim 1, wherein an orthogonal line to a bending center line of the second bent part intersects the first arm part.

3. The connector terminal according to claim 1, wherein a direction in which the first arm part extends is in parallel with a direction in which the second arm part extends.

4. The connector terminal according to claim 1, wherein:

the first contactor comprises:

a first support part extending from the first arm part;

the first bent part provided at a tip of the first support part;

a first fold-back part folded so as to be laid over on the first support part with reference to the first bent part, and extending from the first support part toward the second end of the first arm part; and a first contact piece in contact with the terminal component;

a first protruding part in a circular-arc shape and extending toward the first contact piece is formed at the first support part; and an end face of the first contact piece is formed in a circular-arc shape that expands toward the inserted terminal component so as to match a contour shape of the first protruding part.

5. The connector terminal according to claim 4, wherein:

the second contactor comprises:

a second support part extending from the second arm part;

the second bent part provided at a tip of the second support part;

a second fold-back part folded so as to be laid over on the second support part with reference to the second bent part, and extending from the second support part toward the second end of the second arm part; and a second contact piece in contact with the terminal component;

a second protruding part in a circular-arc shape and extending toward the second contact piece is formed at the second support part; and an end face of the second contact piece is formed in a circular-arc shape that expands toward the inserted terminal component so as to match a contour shape of the second protruding part.

6. The connector terminal according to claim 4, wherein:

a first concavity part is formed in a first surface of the first support part, and a first convexity part corresponding to the first concavity part is formed on a second surface of the first support part;

a second concavity part is formed in a first surface of the first fold-back part, and a second convexity part corresponding to the second concavity part is formed on a second surface of the first fold-back part; and the first convexity part and the second concavity part are engaged with each other.

7. The connector terminal according to claim 6, wherein a third concavity part is formed in the second convexity part.

8. The connector terminal according to claim 7, wherein:

a third convexity part corresponding to the third concavity part is formed on the second concavity part;

a fourth concavity part is formed in the first convexity part; and the third convexity part and the fourth concavity part are engaged with each other.

9. An electrical connector comprising:

the connector terminal according to claim 1; and a housing which retains therein the connector terminal, and which is formed of an insulative material.

10. A method for manufacturing the connector terminal according to claim 1, the method comprising:

a first process of forming a sheet metal comprising an arm part forming area that becomes the first arm part and the second arm part, an interconnection part forming area which extends from the arm part forming area, and which becomes the interconnection part, and a contactor forming area which extends from the arm part forming area, and which becomes the first contactor and the second contactor;

a second process of bending, from the contactor part forming area, a contact piece forming area that becomes a first contact piece and a second contact piece both to be in contact with the terminal component, and causing the first contact piece and the second contact piece to face with each other; and a third process of bending a second end of the contactor part forming area in a manner laid over on a first end thereof so as to cause an orthogonal line to the bending center line of the first bent part and an orthogonal line to the bending center line of the second bent part to intersect the second arm part and the first arm part.

11. The connector terminal manufacturing method according to claim 10, wherein:

the contactor part forming area comprises:

a support part forming area which extends from the arm part forming area, and which becomes the first support part and the second support part;

a fold-back part forming area that becomes a first fold-back part and a second fold-back part to be bent and laid over on the first support part and the second support part, respectively; and the contact piece forming area;

a first protruding part and a second protruding part both formed in a circular-arc shape are formed at the support part forming area; and the second process comprises forming the contact piece forming area in a circular-arc shape in a manner matching a contour shape of the first protruding part and a contour shape of the second protruding part.

12. The connector terminal manufacturing method according to claim 11, further comprising a fourth process of punching the support part forming area and the fold-back part forming area laid over with each other from a side where the support part forming area is present.

13. The connector terminal manufacturing method according to claim 12, further comprising a fifth process of punching a convexity part formed on the support part forming area and a convexity part formed on the fold-back part forming area from a side where the fold-back part forming area is present, the convexity parts both formed in the fourth process.

* * * * *